United States Patent [19]

Kristiansson

[11] 4,182,022

[45] Jan. 8, 1980

[54] DEVICE FOR TOOL CHANGING IN PUNCHING MACHINES

[75] Inventor: Erik Kristiansson, Partille, Sweden

[73] Assignee: Pullmax AB, Sweden

[21] Appl. No.: 916,054

[22] Filed: Jun. 16, 1978

[30] Foreign Application Priority Data

Jun. 21, 1977 [SE] Sweden ..... 7707201

[51] Int. Cl.[2] ..... B23Q 3/155

[52] U.S. Cl. ..... 29/568; 72/446; 83/563

[58] Field of Search ..... 29/26 A, 568; 83/563; 72/446, 447, 448

[56] References Cited

U.S. PATENT DOCUMENTS

| | | | |
|---|---|---|---|
| 3,745,646 | 7/1973 | Kristiansson | 29/568 |
| 3,765,291 | 10/1973 | Stenfeldt | 29/568 X |
| 3,816,904 | 6/1974 | Herb | 29/568 |
| 4,103,414 | 8/1978 | Herb et al. | 29/568 |

*Primary Examiner*—Z. R. Bilinsky

*Attorney, Agent, or Firm*—Robert E. Burns; Emmanuel J. Lobato; Bruce L. Adams

[57] ABSTRACT

Apparatus for changing tools in a punching machine comprises concentric upper and lower turret magazines carrying tools disposed with their axes on concentric pitch circles. Guide means for successively moving the tools from the magazines to an operating position comprises fixed and movable guide portions having complementary guide surfaces for the tools. The fixed guide portion is outside the pitch circles of the magazines and the movable guide portion is movable between a first operating position in engagement with the fixed guide portion, a second changing positions in which the axis of its guide surface intersects the pitch circles of said magazines and a third neutral position inside the pitch circles so that the tools can pass between the fixed and movable guide portions when the magazines are indexed. Gripping means on the movable guide portion grips an axially extending guide key on the tool to retain the tool in the movable guide portion when moving from the first operating position to the second tool-changing position and is then released.

11 Claims, 3 Drawing Figures

DEVICE FOR TOOL CHANGING IN PUNCHING MACHINES

FIELD OF INVENTION

The present invention relates to apparatus for tool changing in a punching machine, especially a turret press, in which coacting pairs of upper punches and lower dies, respectively, are carried in a preparatory position by concentric rotatable turret magazines situated one above the other, with the axes of the tools in each pair registering with each other and distributed along concentric circles on the turret magazine, comprising upper and lower fixed guide portions coacting with upper and lower guide portions adjustable in relation to the turret magazine, for the tools in the operation position, which together form operational guides for the tools and are parted along a plane through the axes of the tools, substantially perpendicular to a radial plane through the vertical axes of the tools and turret magazines.

BACKGROUND OF THE INVENTION

In punching machines where the tools are carried on rotating magazines, it is a general desire that tool changing can be done as quickly as possible. In the original simple turret press, this can be easily achieved by rotating the turret magazine so that the tool is directly moved into the working position. This operation can be carried out with the help of numerical control without difficulty. In this way very rapid automatic tool changing can be achieved with changing times of only two or three seconds.

In further types of punching machines, the tools are carried on separate rotating magazines and transferred from the magazine to special guides in the working position with the help of tool changers. The turret magazine can then be placed at a distance from the point of operation of the tool, the tool changer gripping the tool in the magazine and transferring it to the guides in the operational position. Such tool changers are also automated these days and can be program-controlled. Such a tool changer is shown in U.S. Pat. No. 3,765,291. In this case the tool magazine is placed to one side of the machine frame, and the tools are moved a comparatively long distance from the magazine to the operation position where the tool is guided in a special fixed guide in combination with a complementary guiding portion formed by the gripping means of the tool changer.

The already known turret press offers certain advantages by its compact construction with rotatable turret magazines arranged in the immediate vicinity of the operation position of the tools. The turret magazine can suitably be placed in the gap of the machine frame, whereby a desired simple and compact construction is achieved. The conventional turret press has, however, certain disadvantages which are tied up with the fact that the tools are directly guided in the turret magazine. In a modern numerically controlled turret press it can be desirable to have as many as forty different tools in the magazine. This does not mean, however, that one can place any tool at all in an optional position in the magazine. A usual maximum diameter of a tool is 100 mm. If tools of this size were to be provided for in every position, the magazine would be unreasonably large and heavy. The tool positions in the upper magazine also serve, as already mentioned, as guides for the punch holders which are inserted in the magazine from its upper side. The diameter of the guide must therefore be at least as large as the diameter of the tool, and with forty tool positions this would give a pitch diameter of about 1.5 meter.

For this reason one is compelled to limit the number of tool positions for large diameters, and adjust the number of tools of different diameters in the magazine so that its diameter will not be unreasonably great. Such apparatus thus carries with it the disadvantage that only a limited number of tools having a larger diameter can be included in the magazine.

Further disadvantages in known turret presses with the tools guided in turret plates (turret magazines) have to do with the fact that tools with large diameter often have unsatisfactory guides, the wear occurring making necessary the costly exchange of the whole revolver plate.

SUMMARY OF THE INVENTION

The invention has the object of providing, while avoiding the disadvantages mentioned, a tool changing apparatus in a turret press which enables desired compact construction of the press and turret magazine and thereby provides the opportunity of including a large number of tools with relatively large diameter in the turret magazine without its diameter becoming troublesomely large.

This object according to the invention is achieved by a punching machine of the kind mentioned in the introduction, by having the fixed guide portions for the tools lying on one side of the pitch circles of the turret magazine, while the movable guide portions are radially adjustable relative to the magazine for assuming a first working position while abutting against the fixed guide portion, a second changing position in which the axis of the guiding surface of the portion cuts the pitch circles of the magazine, and a third neutral position on the inside of the pitch circles for allowing passage of tools between the fixed and the movable parts when the magazine is rotated.

The fixed portion of the work operation guides is thereby preferably situated radially outside, and the movable portion radially inside said parting plane.

The movable portion of the work operation guides is suitably provided with gripping means for the tools. Said means can consist of pneumatically/hydraulically operated locking claws engaging with axial keys on the tools. The fixed and the movable guide portions are locked to each other in the operation position of the tools by clamping jaws coacting with flange portions outstanding from the guide portions.

The tools carried by the turret magazine can suitably have identical guiding surfaces independent of the dimension of the coacting working portions of the tools. A ratio of length to diameter of the guiding surfaces of the movable punches of at least 2.5 is thereby preferred.

BRIEF DESCRIPTION OF DRAWINGS

The invention is described below in the form of a preferred embodiment shown by way of example in the accompanying drawings in which.

DESCRIPTION OF PRIOR ART

Figure 1:
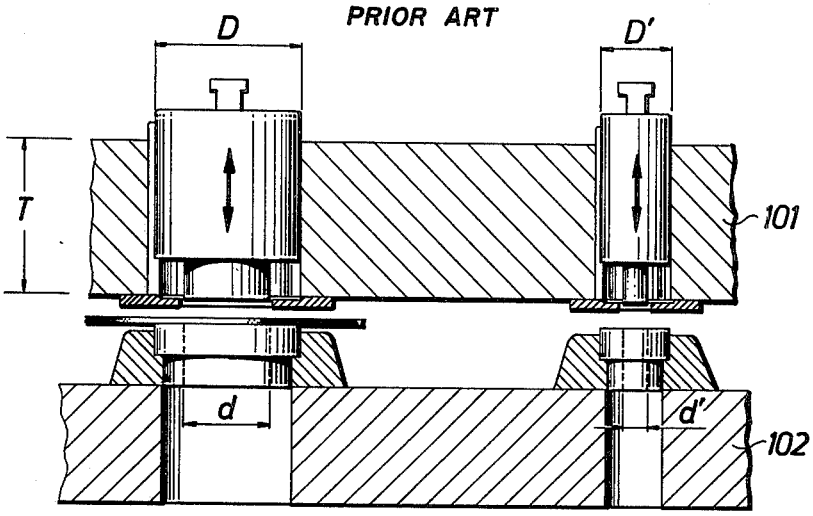
Fig. 1 PRIOR ART
FIG. 1 shows the development of a partially cylindrical section through the turret plates in a conventional turret press with two tools of different diameters placed in the plates.
Figure 2:
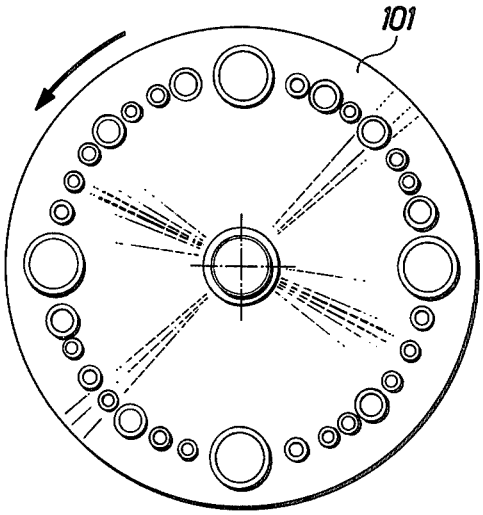
Fig. 2 PRIOR ART
FIG. 2 schematically shows in plan a conventional revolver plate carrying tools of varying dimensions.

The arrangement of tools in a conventional turret press is apparent from FIGS. 1 and 2. The turret plates 101,102 are placed in the horizontal gap in the machine frame, which is not shown. Each tool pair comprises a punch vertically guided in the upper turret plate 101 and a stationary die attached to the lower turret plate 102. In the work operation position, the punch and die are registered coaxially with each other and the die is coupled to a vertically operating driving means. The upper die is usually guided in a special bushing (not shown) and is kept in a definite angular attitude by a vertical guide key indicated on the figure. To the left in FIG. 1 there is shown a tool with maximum diameter and to the right a tool with a less diameter. Taking into account that the height T of the upper turret plate has a certain limitation, for practical reasons, it will be appreciated that the ratio of diameter D to guide length T for a large tool with the diameter d is relatively unfavourable in that the diameter will be too great in relation to the guide length, with the accompanying risk of binding. The smaller tool with the diameter d' and guide diameter D' is given more favourable guiding conditions for a given height T of the turret plate.

FIG. 2 shows the arrangement of tools in varying sizes on the turret plate 101. In the example shown, thirty tools are carried by the turret plate, whereof only four have relatively large diameter.

For each new set-up of a tool set in the turret plates, the die holder with die must be adjusted to the punch. This requires a not insignificant working time of 1 to 5 minutes. In a program-controlled machine with a high hourly cost, this means great costs for the setting-up of about ten tools, for example.

As illustrated in FIG. 2, it will be further seen that only a limited number of tools with a large diameter can be carried by a revolver plate of reasonable dimensions.

DESCRIPTION OF PREFERRED EMBODIMENT

Figure 3:
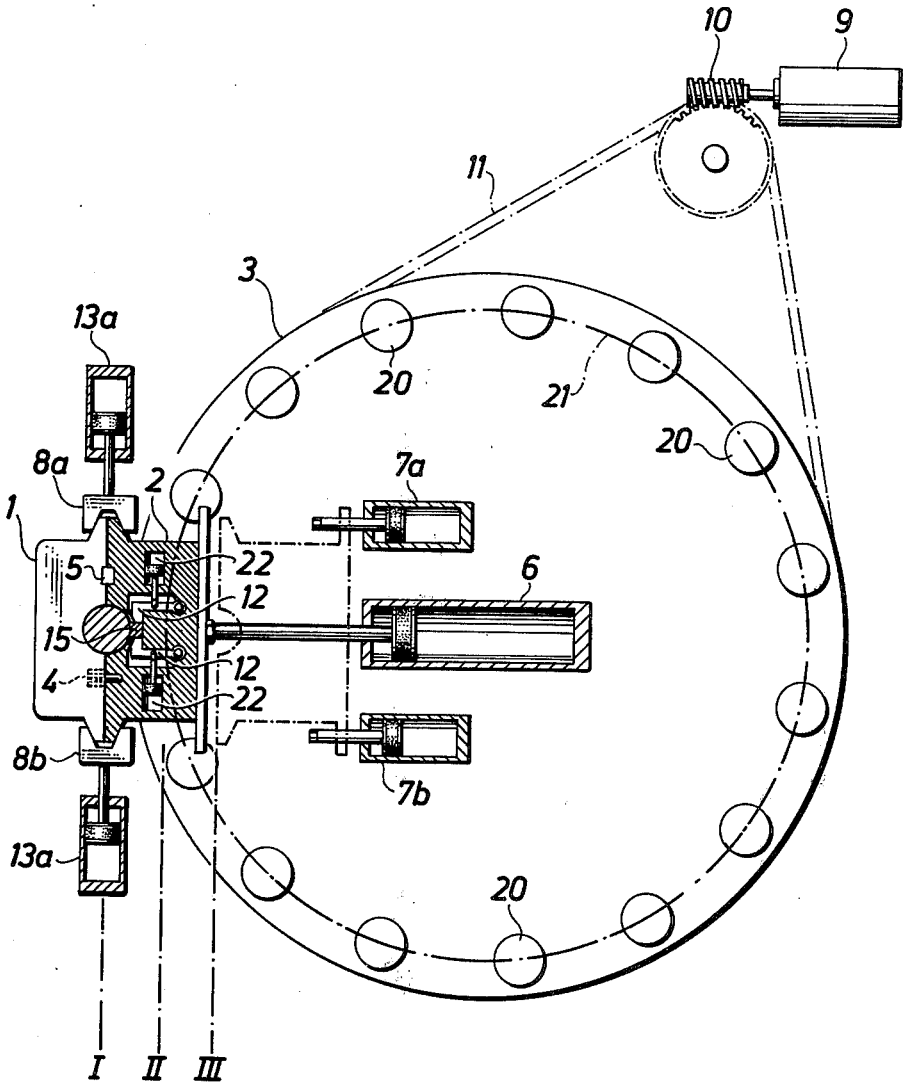
FIG. 3 schematically shows in plan the tool changing apparatus according to the invention.

FIG. 3 shows a tool changing apparatus according to the invention as applied to a turret press. The apparatus is schematically shown in plan and is assumed fitted in the gap of a machine frame, not shown. In the machine frame gap there are rotatably mounted two turret magazines 3 coaxially one above the other. These magazines carry the tool pairs (punch and die) generally denoted by the numeral 20, with the tools in each pair coaxially above each other. The tool pairs are preferably arranged at an even pitch on the pitch circles 21. In the operation position, the tools are guided in upper and lower operational guides formed by a fixed guide portion 1 and a guide portion 2 movable in relation thereto. The guide portion 2 is radially movable in relation to the turret magazine 3. This tool guide functions in principle as disclosed in the previously mentioned U.S. Pat. No. 3,765,291. According to the invention, the tools are in the operational position on one side of the pitch circles of the turret magazines 3. The movable guide portion 2 then coacts with the fixed guide portion 1 and abuts against it along a parting plane through the axes of the tool pairs, perpendicular to a plane through these axes and the rotational axes of the turret magazines. In a fixed operation position, the guide portions are kept to each other with the help of location pins 4 and wedges 5.

In the operation position, the upper vertical movable tool is coupled to a conventional driving means to obtain a reciprocating vertical movement while working.

In the operation position, both guide portions 1 and 2 are locked to each other with the help of clamping jaws 8*a,b* coacting with flanges projecting from the respective guide portions, said flanges having converging side surfaces engaging in complementary V-shaped recesses in the clamping jaws. The clamping jaws 8*a,b* are urged against the flanges of the guiding portions 1 and 2 with the aid of piston/cylinder units 13*a,b* driven by a pressure medium.

The movable guide portion 2 is, according to the invention, settable in three positions, namely the operation position I already mentioned, a changing position II and a neutral position III indicated respectively by the lines I, II and III in FIG. 3. This is provided with the help of a piston/cylinder unit 6 driven by a pressure medium and connected to the guide portion.

The guide portion 2 is provided with an axial groove for accommodating a guide key 15 connected to the respective tool for guiding the tool in the intended angular attitude. A pair of gripping claws 12 are further built onto the guide portion 2 and operated by piston/-cylinder units 22 driven by a pressure medium and arranged for gripping the guide keys 15. The apparatus further includes a pair of piston/cylinder units 7*a,b* driven by a pressure medium, and having piston rods adapted to abut the rear face of the movable portion 2 to serve as temporary arresting means in the second changing position II when the guide portion 2 is moved away from the fixed portion 1.

The turret magazine is rotated to specified positions for tool changing with the help of a program-controlled pulse motor 9 which, via a worm and wheel reduction gear 10 and a chain transmission 11, is connected to the turret magazine. It will be appreciated that this rotation of the turret magazine and the tools carried by it can take place unobstructed when the guide portion 2 is in its neutral position III, allowing the tools to pass freely between guide portions 1 and 2. The tools are carried at the periphery of the turret magazine 3 by suitable means in a similar way as the apparatus according to said U.S. Pat. No. 3,765,291.

When exchanging a tool pair in the operation position, the apparatus described functions in the following manner.

1. In operation position I of the guide portion 2, the gripping claws 12 operated by the piston/cylinder units 2 grip opposing sides of the guide keys 15 of the coacting tools.

2. The clamping jaws 8*a,b* are released from the converging flange portions on the guide portions 1,2 with the help of the piston/cylinder units 13*a,b*.

3. The guide portion 2 can now be released from the guide portion 1 and is moved by the piston/cylinder unit 6 to the changing position II, carrying with it the upper and lower tool which are kept in the guide portion 2 by the gripping claws 12. In position II, the guide portion 2 is arrested with the help of the piston/cylinder units 7*a,b* which project their piston rods towards the guide portion 2 to form an abutment for it in this arresting position. The tools are simultaneously accommodated in free tool positions brought into position beforehand in the turret magazine.

4. The claws 12 release their grip on the guide keys 15.

5. Pressure medium behind the pistons in the piston/-cylinder units 7*a,b* is evacuated so that the piston/cylinder unit 6 can take the guide portion 2 to the neutral position III during continued withdrawing movement. The guide portion 2 has then released the tool, which is accommodated in the respective turret magazine 3.

6. The turret magazine 3 is rotated and moves a new tool the shortest distance to the changing position II. The tools can pass without hindrance between the guide portions 1 and 2.

7. The respective guide portions 2 are taken by the piston/cylinder unit 6 from position III directly to the operation position I. The new tools standing in the changing position II are thereby simultaneously moved to operation position I. The claws 12 do not need to grip the guide keys 15 in this case.

8. The clamping jaws 8*a,b* are pressed by the piston/-cylinder units 13*a,b* against the converging flanges on the guide portions 1 and 2 to lock these against each other after they have been fixed in position with the help of the guide wedges 5 and pins 4. The working cycle is thereby completed.

Punches and dies have attachment portions of principally similar shape and are handled in the same way.

The following advantages are obtained with the described apparatus:

1. Each position in the magazine can be charged with a tool up to the maximum prevailing dimension.

2. The guide diameter for the punch holder can be selected independent of the size of the tool and can be the same for all tools as well as being in a suitable relationship to the length of the guide to obtain stability comparable with the stability of so-called single punching machines.

3. The tools are automatically squared-up in the fixed guide portions. Accuracy is thus not affected by wear in locking rams and bushes.

4. When setting up tools in the magazine, there is no need to register the punch with the die and setting up is therefore very rapid, about 10 seconds for each tool position.

What is claimed is:

1. Apparatus for changing tools in punching machines, especially turret presses, comprising concentric upper and lower rotatable turret magazines one above the other, a plurality of pairs of tools carried by said magazines with axes of said tools disposed on concentric pitch circles of said magazines, each of said pairs of tools comprising a punch carried by one of said magazines and a mating die carried by the other of said magazines, and guide means for successively moving said tools from said magazines to an operating position, guiding said tools in said operating position and returning said tools to said magazines, said guiding means comprising:

a fixed guide portion outside said pitch circle of said magazines and having a guide surface for a tool, a movable guide portion having a guide surface for said tool, said movable guide portion being movable radially of said magazines between a first operating position in engagement with said fixed guide portion, a second changing position in which the axis of said guide surface of said movable guide portion intersects the pitch circles of said magazines and a third neutral position on the inside of said pitch circles of said magazines to allow tools carried by said magazines to pass between said fixed guide portion and said movable guide portion when said magazines are rotated, means for moving said movable guide portion between said first, second and third positions, means for clamping said fixed guide portion and said movable guide portion together when said movable guide portion is in said first position, and means for retaining said tool in said movable guide portion during movement of said movable guide portion from said first position to said second position.

2. Apparatus according to claim 1, in which said retaining means comprises means carried by said movable guide portion for gripping and retaining the tool while transferring it from said first position to said second position.

3. Apparatus according to claim 2, in which said tool has an axial guide key engaging in a guiding groove in said movable guide portion, and in which said gripping means comprises locking jaws operable to grip said axial guide key of said tool.

4. Apparatus according to claim 3, comprising fluid pressure means for operating said locking jaws.

5. Apparatus according to claim 1, in which said means for clamping said fixed guide portion and said movable guide portion together when said movable guide portion is in said first position comprises projections with converging side surfaces on said guide portions at opposite sides of a parting plane between said guide portions and clamping jaws provided with complementary V-shaped recesses engageable with said converging side surfaces of said projections and means for moving said clamping jaws in a direction parallel to said parting plane into and out of engagement with said projections.

6. Apparatus according to claim 5, in which said means for moving said clamping jaws comprises fluid pressure operable means acting on said jaws.

7. Apparatus according to claim 1, in which said means for moving said movable guide portion comprises a first piston-cylinder unit operable by fluid pressure, and in which a second piston-cylinder unit operable by fluid pressure temporarily arrests said movable guide portion in said second position when moved from said first position by said first piston-cylinder unit.

8. Apparatus according to claim 7, in which said means for retaining said tool in said movable guide member comprises means carried by said movable guide member for gripping said tool, and in which said gripping means is released during the arresting of said movable guide member in said second position by said second portion-cylinder unit.

9. Apparatus according to claim 1, in which said tools have identical guide surfaces independent of the dimension of coacting working surfaces of said tools.

10. Apparatus according to claim 9, in which the ratio of length to diameter of said guide surfaces of said guide portions is at least 2.5.

11. Apparatus according to claim 1, comprising a numerically controlled pulse motor for rotating said turret magazines.

* * * * *